US008240399B2

(12) United States Patent
Kulkarni et al.

(10) Patent No.: US 8,240,399 B2
(45) Date of Patent: Aug. 14, 2012

(54) DRILL BIT WITH AN ADJUSTABLE STEERING DEVICE

(75) Inventors: Ajay V. Kulkarni, The Woodlands, TX (US); David K. Luce, Splendora, TX (US); John F. Bradford, Fort Worth, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 13/038,993

(22) Filed: Mar. 2, 2011

(65) Prior Publication Data

US 2011/0147089 A1 Jun. 23, 2011

Related U.S. Application Data

(62) Division of application No. 12/535,326, filed on Aug. 4, 2009, now Pat. No. 8,087,479.

(51) Int. Cl.
*E21B 7/08* (2006.01)
*E21B 7/12* (2006.01)

(52) U.S. Cl. ..... 175/73; 175/76; 175/408

(58) Field of Classification Search ..... 175/73, 175/76, 408

See application file for complete search history.

(56) References Cited

U.S. PATENT DOCUMENTS

| | | | | |
|---|---|---|---|---|
| 3,422,672 | A * | 1/1969 | Payne | 73/152.53 |
| 4,086,698 | A | 5/1978 | Sparks | |
| 4,102,415 | A * | 7/1978 | Cunningham | 175/96 |
| 4,185,704 | A | 1/1980 | Nixon, Jr. | |
| 4,262,758 | A | 4/1981 | Evans | |
| 4,291,773 | A | 9/1981 | Evans | |
| 4,416,339 | A | 11/1983 | Baker et al. | |
| 4,638,873 | A | 1/1987 | Welborn | |
| 4,730,681 | A | 3/1988 | Estes | |
| 4,770,258 | A * | 9/1988 | Falgout, Sr. | 175/73 |
| 4,842,083 | A * | 6/1989 | Raney | 175/325.4 |
| 4,856,601 | A * | 8/1989 | Raney | 175/393 |
| 5,158,109 | A | 10/1992 | Hare, Sr. | |
| 5,220,963 | A | 6/1993 | Patton | |
| 5,293,945 | A | 3/1994 | Rosenhauch et al. | |
| 5,341,886 | A | 8/1994 | Patton | |
| 5,419,405 | A | 5/1995 | Patton | |
| 5,423,389 | A * | 6/1995 | Warren et al. | 175/75 |
| 5,443,565 | A | 8/1995 | Strange, Jr. | |
| 5,467,834 | A | 11/1995 | Hughes et al. | |
| 5,547,031 | A * | 8/1996 | Warren et al. | 175/61 |
| 5,553,678 | A | 9/1996 | Barr et al. | |
| 5,560,439 | A * | 10/1996 | Delwiche et al. | 175/325.1 |
| 5,582,260 | A | 12/1996 | Murer et al. | |
| 5,671,816 | A | 9/1997 | Tibbitts | |
| 5,941,321 | A | 8/1999 | Hughes | |

(Continued)

FOREIGN PATENT DOCUMENTS

EP 530045 A1 * 3/1993

(Continued)

*Primary Examiner* — Jennifer H Gay
(74) *Attorney, Agent, or Firm* — Cantor Colburn LLP

(57) ABSTRACT

A drill bit is provided that includes a force application device on a body of the drill bit. The force application device includes a floating member and a force application member configured to extend from the floating member to apply a force on a wellbore wall when the drill bit is used to drill a wellbore and an actuator configured to actuate the force application member to apply the force to a wellbore wall during drilling of the wellbore.

18 Claims, 9 Drawing Sheets

U.S. PATENT DOCUMENTS

| | | | | |
|---|---|---|---|---|
| 5,941,323 | A * | 8/1999 | Warren | 175/74 |
| 6,012,536 | A | 1/2000 | Puttmann et al. | |
| 6,092,610 | A | 7/2000 | Kosmala et al. | |
| 6,138,780 | A | 10/2000 | Beuershausen | |
| 6,142,250 | A | 11/2000 | Griffin et al. | |
| 6,173,797 | B1 | 1/2001 | Dykstra et al. | |
| 6,209,664 | B1 | 4/2001 | Amaudric du Chaffaut | |
| 6,253,863 | B1 | 7/2001 | Mensa-Wilmot et al. | |
| 6,257,356 | B1 | 7/2001 | Wassell | |
| 6,260,636 | B1 | 7/2001 | Cooley et al. | |
| 6,290,007 | B2 | 9/2001 | Beuershausen et al. | |
| 6,318,462 | B1 * | 11/2001 | Tessier | 166/206 |
| 6,321,862 | B1 | 11/2001 | Beuershausen et al. | |
| 6,349,780 | B1 | 2/2002 | Beuershausen | |
| 6,568,470 | B2 | 5/2003 | Goodson, Jr. et al. | |
| 6,681,853 | B2 * | 1/2004 | Doyle et al. | 166/214 |
| 6,725,947 | B2 | 4/2004 | Palaschenko et al. | |
| 6,880,648 | B2 * | 4/2005 | Edscer | 175/61 |
| 6,880,649 | B2 * | 4/2005 | Edscer | 175/73 |
| 6,968,897 | B2 * | 11/2005 | Doyle et al. | 166/214 |
| 6,971,459 | B2 * | 12/2005 | Raney | 175/408 |
| 7,201,237 | B2 | 4/2007 | Raney | |
| 7,287,604 | B2 | 10/2007 | Aronstam et al. | |
| 7,373,995 | B2 | 5/2008 | Hughes et al. | |
| 7,669,668 | B2 * | 3/2010 | Martinez et al. | 175/40 |
| 7,849,939 | B2 | 12/2010 | Downton et al. | |
| 7,900,708 | B2 * | 3/2011 | Obrejanu | 166/382 |
| 2002/0011358 | A1 | 1/2002 | Wassell | |
| 2002/0088648 | A1 | 7/2002 | Krueger et al. | |
| 2002/0100617 | A1 * | 8/2002 | Watson et al. | 175/73 |
| 2002/0112887 | A1 | 8/2002 | Harrison | |
| 2004/0238221 | A1 | 12/2004 | Runia et al. | |
| 2005/0024232 | A1 | 2/2005 | Gardner et al. | |
| 2007/0119629 | A1 * | 5/2007 | Hughes et al. | 175/73 |
| 2008/0000693 | A1 | 1/2008 | Hutton | |
| 2008/0083567 | A1 | 4/2008 | Downton et al. | |
| 2008/0245570 | A1 * | 10/2008 | Partouche | 175/48 |
| 2009/0044951 | A1 * | 2/2009 | Milkovisch et al. | 166/369 |
| 2009/0044979 | A1 * | 2/2009 | Johnson et al. | 175/24 |
| 2009/0065262 | A1 | 3/2009 | Downton et al. | |
| 2009/0194334 | A1 * | 8/2009 | Johnson et al. | 175/61 |
| 2010/0071956 | A1 * | 3/2010 | Beuershausen | 175/61 |
| 2010/0071962 | A1 * | 3/2010 | Beuershausen | 175/399 |
| 2011/0031025 | A1 * | 2/2011 | Kulkarni et al. | 175/76 |
| 2011/0147089 | A1 * | 6/2011 | Kulkarni et al. | 175/73 |
| 2011/0162890 | A1 * | 7/2011 | Radovan | 175/61 |

FOREIGN PATENT DOCUMENTS

| | | | |
|---|---|---|---|
| EP | 1008717 | A1 | 6/2000 |
| GB | 2039567 | A | 8/1980 |
| GB | 2050466 | A | 1/1981 |
| GB | 2352464 | A | 1/2001 |
| WO | WO0043628 | | 7/2000 |

* cited by examiner

DRILL BIT WITH AN ADJUSTABLE STEERING DEVICE

1. RELATED APPLICATIONS

This application is a divisional of application Ser. No. 12/535,326, filed Aug. 4, 2009, which issued as U.S. Pat. No. 8,087,479 on Jan. 3, 2012.

BACKGROUND INFORMATION

1. Field of the Disclosure

This disclosure relates generally to drill bits, methods of making drill bits and systems for using same for drilling wellbores.

2. Background of the Art

Oil wells (also referred to as wellbores or boreholes) are drilled with a drill string that includes a tubular member having a drilling assembly (also referred to as a "bottomhole assembly" or "BHA") which includes a drill bit attached to the bottom end thereof. The drill bit is rotated to disintegrate the rock formation to drill the wellbore. The BHA includes devices and sensors for providing information about a variety of parameters relating to the drilling operations (drilling parameters), behavior of the BHA (BHA parameters) and the formation surrounding the wellbore being drilled (formation parameters). A large number of wellbores are drilled along a contoured trajectory. For example, a single wellbore may include one or more vertical sections, deviated sections and horizontal sections. Some BHA's include adjustable knuckle joints to form a deviated wellbore. Such steering devices are typically disposed on the BHA, i.e., away from the drill bit. However, it is desirable to have a steering device close to or on the drill bit to cause the drill bit to change drilling directions faster than may be achievable with steering devices that are in the BHA, to drill smoother deviated wellbores, to improve rate of penetration of the drill bit and/or to extend the drill bit life.

The disclosure herein provides drill bits with steering devices, methods of making such bits and apparatus for using such drill bits for drilling wellbores.

SUMMARY

In one aspect, a drill bit is provided that in one embodiment includes a force application device on a body of a drill bit, the force application device including a floating member and a force application member configured to extend from the floating member to apply a force on a wellbore wall when the drill bit is used to drill a wellbore. The drill bit further includes an actuator configured to actuate the force application member to apply the force to a wellbore wall during drilling of the wellbore.

In another aspect, a method of making a drill bit is provided which method may include providing at least one force application device on a body of the drill bit, wherein the force application device. The method further includes providing a floating member and a force application member on the force application device, the force application member configured to extend from the floating member to apply a force on a wellbore wall when the drill bit is used to drill a wellbore and providing an actuator configured to actuate the force application member to apply the force to a wellbore wall during drilling of the wellbore Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

The disclosure herein is best understood with reference to the accompanying figures in which like numerals have generally been assigned to like elements and in which.

DETAILED DESCRIPTION OF THE EMBODIMENTS

Figure 1:
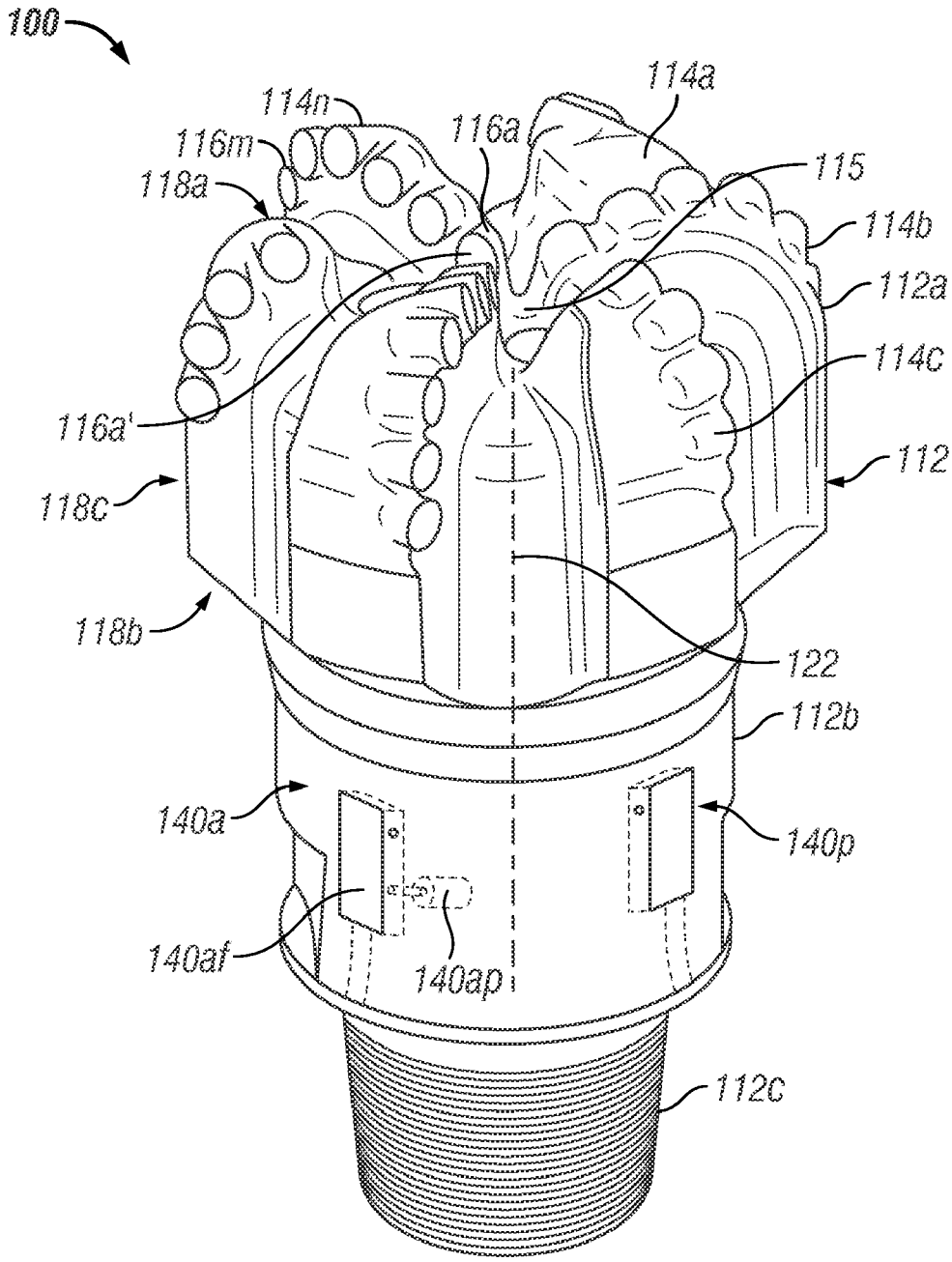
FIG. 1 is an isometric view of an exemplary drill bit with a steering device on a shank section of a drill bit, according to one embodiment of the disclosure.

FIG. 1 shows an isometric view of an exemplary drill bit 100 made according to one embodiment of the disclosure. The drill bit 100 shown is a PDC bit having a bit body 112 that includes a cone 112*a*, shank 112*b*, and a pin 212*c*. The cone 112*a* is shown to include a number of blade profiles 114*a*, 114*b*, . . . 114*n* (also referred to as the "profiles"). Each blade profile is shown to include a face or crown section, such as section 118*a* and a gage section, such as section 118*b*. A portion of the shank 112*b* is substantially parallel to the longitudinal axis of 122 of the drill bit 100. A number of spaced-apart cutters are placed along each blade profile. For example, blade profile 114*n* is shown to contain cutters 116*a*-116*m*. All blade profiles 114*a*-114*n* are shown to terminate proximate to the bottom center 115 of the drill bit 100. Each cutter has a cutting surface or cutting element, such as element 116*a*' of cutter 116*a*, that engages the rock formation when the drill bit 100 is rotated during drilling of the wellbore. Each cutter 116*a*-116*m* has a back rake angle and a side rake angle that defines the depth of cut of the cutter into the rock formation. Each cutter also has a maximum depth of cut into the formation. In one aspect, a number of extensible force application devices are placed around the shank 112*b* of the drill bit 100. FIG. 1 shows exemplary force application devices 140*a*-140*p* placed around the shank 112*b*. Each force application device may further include a force application member and an actuation device or a source to supply power to its associated force application member. For example, the force application device 140*a* may include a force application member 140*af* and power source 140*ap*. In one aspect, the force application member may be referred to as pad, pad member, extender or extensible member. Further, the power source may also be referred to as an actuator or an actuating device. The actuator may be any suitable device, including, but not limited to, a hydraulic device, screw device, linear electrical device, an electro-mechanical device, Shape Memory Alloy (SMA) or any other suitable device. Each force application member may be independently actuated to extend radially from the drill bit to apply a selected amount of force on the wellbore wall during drilling of the wellbore. Various embodiments of the force application devices and their operations are described in more detail in reference to FIGS. 2-9. FIG. 1 shows a PDC drill bit as an example only. The force application devices described herein may be utilized with any other drill bit, including, but not limited to, roller cone drill bits and diamond cutter drill bits.

Figure 2:
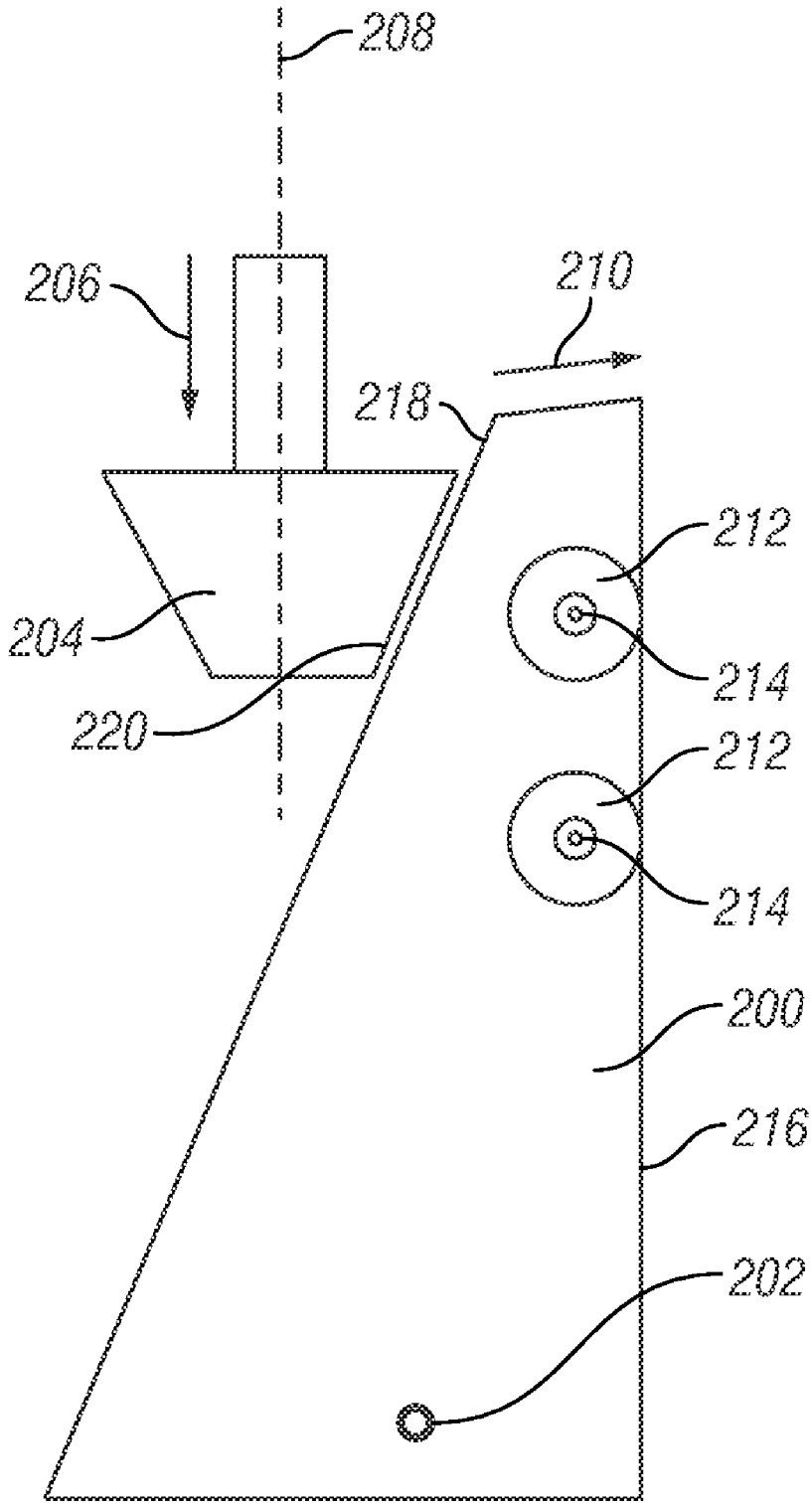
FIG. 2 is a side view of components of an exemplary steering device located on a drill bit, according to one embodiment of the disclosure.

FIG. 2 illustrates a side view of an exemplary force application member or pad 200 and other components which may be included in the drill bit. In one aspect, a hinge member 202, depicted as a pin, may work in combination with a wedge member 204, to move the pad 200 away from the drill bit body. Further, the movement of the pad 200 may be coordinated with one or more other pads on the drill bit to steer the drill bit within a formation. The wedge member 204 may move in a linear direction 206, along a longitudinal axis 208, to actuate movement of the pad 200 in a radial direction 210. The wedge member 204 may be actuated by any suitable mechanism to provide force to move the pad 200, pressing it in an outward direction 210 against a formation wall. Examples of mechanisms to move the wedge member 204 may include a fluid-based actuator (e.g., hydraulic), screw-based actuator, an electrical actuator, shape memory alloys or any other suitable mechanism. In one aspect, a member composed in part of a shape memory alloy may be coupled to and actuate the pad movement. For instance, a member composed of a Shape Memory Alloy, such as nickel titanium, copper-zinc-aluminum-nickel, copper-aluminum-nickel, or iron-based alloys, may be a component of the member, wherein the shape of the metal changes when induced by a thermal change or by a stress applied to the member. As discussed below, the pad 200 may be positioned in a drill bit to provide a relatively precise control of the drill bit direction during drilling of a wellbore.

Still referring to FIG. 2, in one embodiment, the pad 200 also may include rollers 212 positioned on axial members 214, such as pins. The rollers 212 may reduce friction as the pad 200 contacts a formation wall. As such, the rollers 212 may facilitate movement of the drill bit and the bit pads 200 along a wellbore as the drill bit moves down the formation. The rollers 214 may also reduce wear on an outer surface 216 of the pad 200 as the bit moves down the formation. As the wedge member 204 moves axially in direction 206, a pad surface 218 and a wedge surface 220 interface or cooperate to drive the pad movement 210. The surfaces 218 and 220 may include a reduced friction layer made from a suitable material, including, but not limited to, a metallic or alloy coating, non-metallic materials, a combination of such materials, polymers or other suitable materials to enable a sliding movement and transfer of force between the wedge member 204 and pad 200. The wedge member 204 and pad 200 may be composed of any suitable wear resistant material of sufficient strength, such as stainless steel, metal alloys, polymers or any combination thereof. Further, the wedge member 204 may be any suitable shape, such as a pie shape or triangular shape with an angular intersection of two sides, wherein the shape enables a transfer of force from one direction to another. For example, the wedge member 204 may have an angle of about 25 degrees between adjacent sides and enables a force applied generally perpendicular to a third side to be smoothly transferred to the wedge surface 220 to drive movement 210. In addition, the rollers 212 may be of any suitable shape, such as substantially round "wheels" or a rounded polygon. In an aspect, the roller 212 wheels may be made of a any suitable material, including, but not limited to, metallic elements, non-metallic elements and a combination thereof. The rollers 212 reduce rotational and tangential friction against a wellbore wall and assist a pad 200 actuator in transferring the steering force in an outward direction against the wall.

Figure 3:
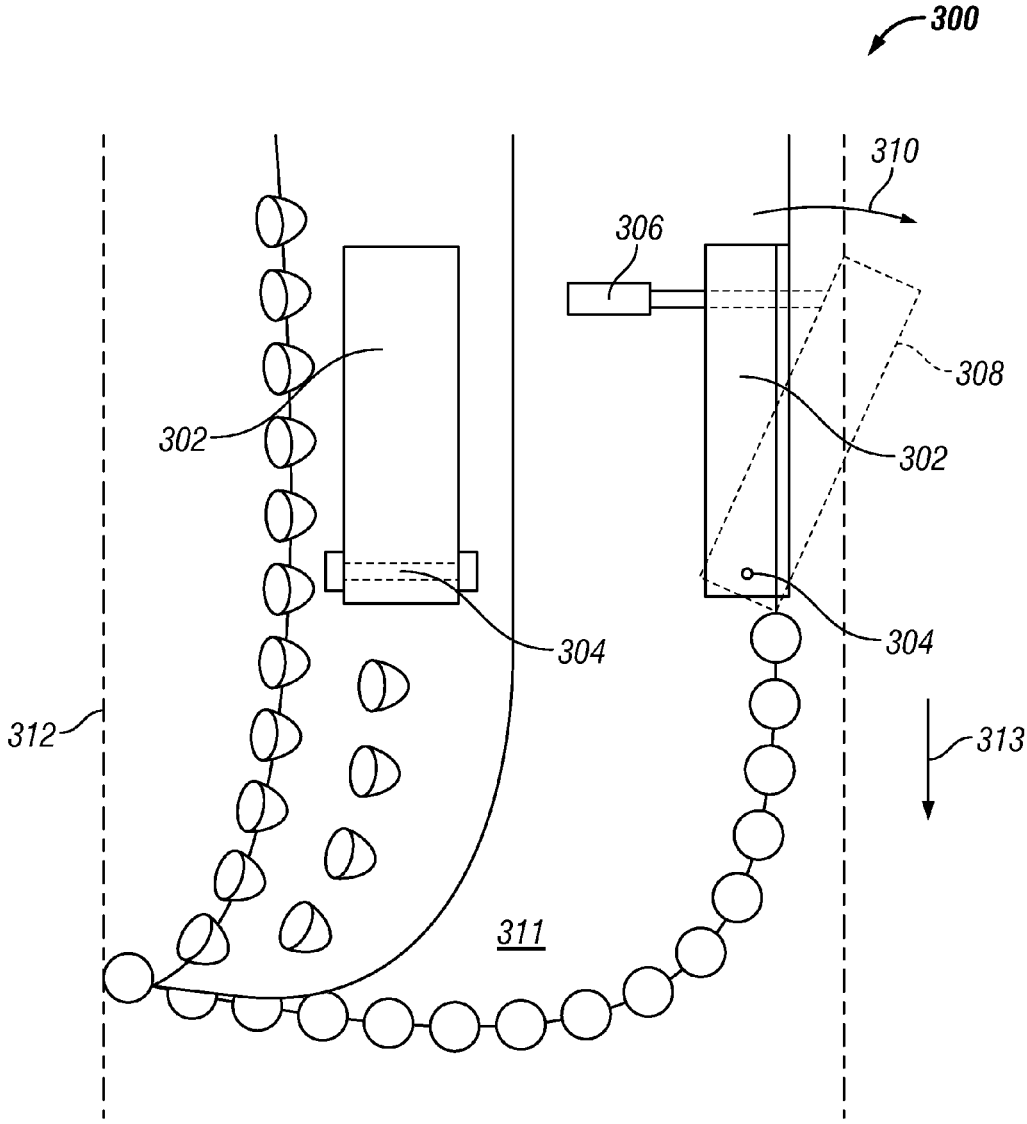
FIG. 3 is a sectional view of a portion of an exemplary drill bit with two force application members, including a profile of a single pad in extended position according to one embodiment of the disclosure.

FIG. 3 shows a sectional side view of a profile of a drill bit 300, made according to one embodiment of the disclosure. A profile of half of the drill bit 300 is illustrated from a longitudinal axis 312 outward. The drill bit 300 is shown to include a plurality of pads 302, which may be placed at one of various locations on the drill bit 300 to steer the drill bit during drilling of a wellbore. In one aspect, three or more pads 302 may be evenly spaced around an exterior of the drill bit 300, such as on the shank of the drill bit 300. For example, each of the pads 302 may be 120 degrees from the other two pads when three pads are used or 90 degrees apart from its adjacent pad when four pads are used, etc. In one aspect, the pads 302 may be attached to the body of the drill bit 300 via a pivot mechanism 304, such as hinge pins, thereby enabling movement of the pads 302 to steer the bit 300. Any suitable pivoting coupling mechanism may be used to enable movement of the pads 302, including, but not limited to, bearing assemblies, pins and stationary pin receivers, pivotally coupled and concealed flaps, or any combination thereof. As will be discussed, below, the pads 302 may also be directly attached to a linear actuator 302, wherein the linear actuator may linearly press the entire pad 302 outward to steer the bit. As depicted in FIG. 3, an actuator 306 may be coupled to each pad and cause angular movement of the pad 302 to an extended position 308. Accordingly, the actuator 306 is coupled to the pad 302, via a pivotal coupling, to translate the linear motion (actuation) to an angular or radial movement 310 of the pad 302. In another aspect, the hinge pin 304 may be located closer to a crown portion 311 of the bit, thereby enabling the pad 302 to extend without catching on a formation wall as the bit 300 and pad 302 move in a direction 313. In one aspect, the hinge pin 304 may be located in the pad 302 portion located further from the crown 311. As such, the actuator may be located closer to the crown 311 to move the pad 302. In aspects, in the embodiment of FIG. 3, the pad axis 304' in its retracted position is along the drill bit longitudinal axis 312.

Still referring to FIG. 3, the hinge pin 304 mechanism may be referred to as pivotal with an axis at an angle to the longitudinal axis 312. In one aspect, the angle may be perpendicular or substantially perpendicular to the axis 312. As discussed below, the orientation of the pivot mechanism may vary, thereby altering the pad configuration and direction of pad movement. Moreover, the pad 300 actuation mechanism may vary, depending on application needs and other design and operation factors.

Figure 4:
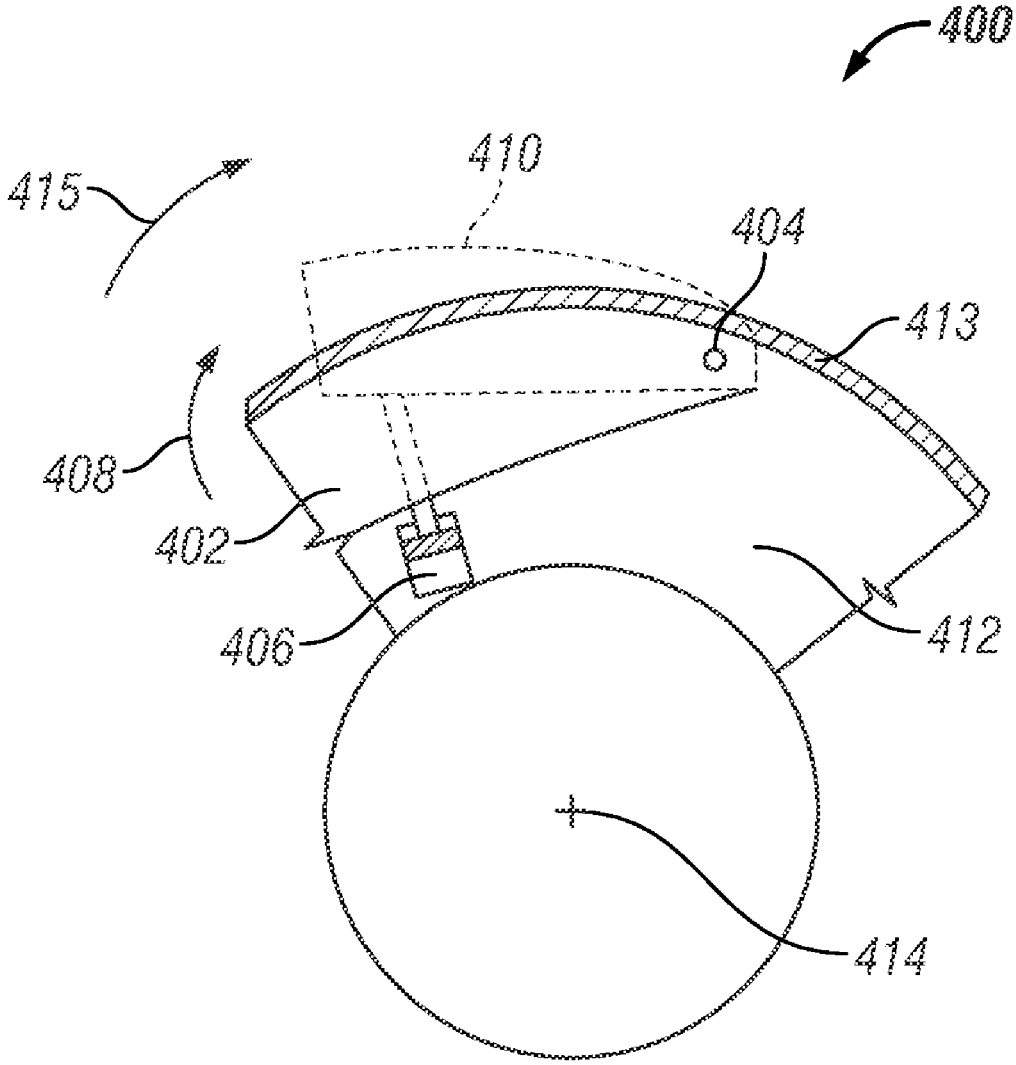
FIG. 4 is a top view of a portion of an exemplary drill bit including a force application member, according to one embodiment of the disclosure.

FIG. 4 is a sectional top view of a portion of an exemplary bit 400. The bit 400 includes a pad 402, which may be configured to steer and control a direction of the bit 400 during a drilling process. The pad 402 may pivot about a hinge 404 coupled to a bit body 412 and the pad 402. An actuating mechanism 406 may be used to move the pad in a direction 408 to an extended position 410. When not extended, the pad 402 may retract into the drill bit body 412, where it is substantially flush with an outer surface 413 of the bit and pad. Further, the outer surface 413 of the bit and pad may include a wear resistant material to reduce wear as the bit 400 rotates against rock to create a wellbore, as described previously. As depicted in FIG. 4, the hinge 404 pivots about an axis that is parallel or substantially parallel to a longitudinal axis 414. In addition, the bit 400 rotates about the longitudinal axis 414 in a direction 415. The pad 402 may extend or retract as the bit 400 rotates. Pad 402 thus steer the bit 400 as it is drilling. Accordingly, the bit 400 may include sensors, processors, memory, and communication devices to enable the bit 400 to extend the pad 402 at the proper time and duration to move the bit 400 in a desired direction. Further, by positioning the pad 402 within the drill bit 400, the steering and drilling of the drill bit may be more precisely controlled. The drill bit 400 may contain a plurality of pads 402 located on the outer portions of the bit. The bit may feature pads of the same configuration and orientation, such as those with hinge axes parallel or perpendicular to the longitudinal axis or at any other suitable angle to longitudinal drill bit axis. In one embodiment, a combination of pad configurations may be used to steer a single bit assembly.

Figure 5:
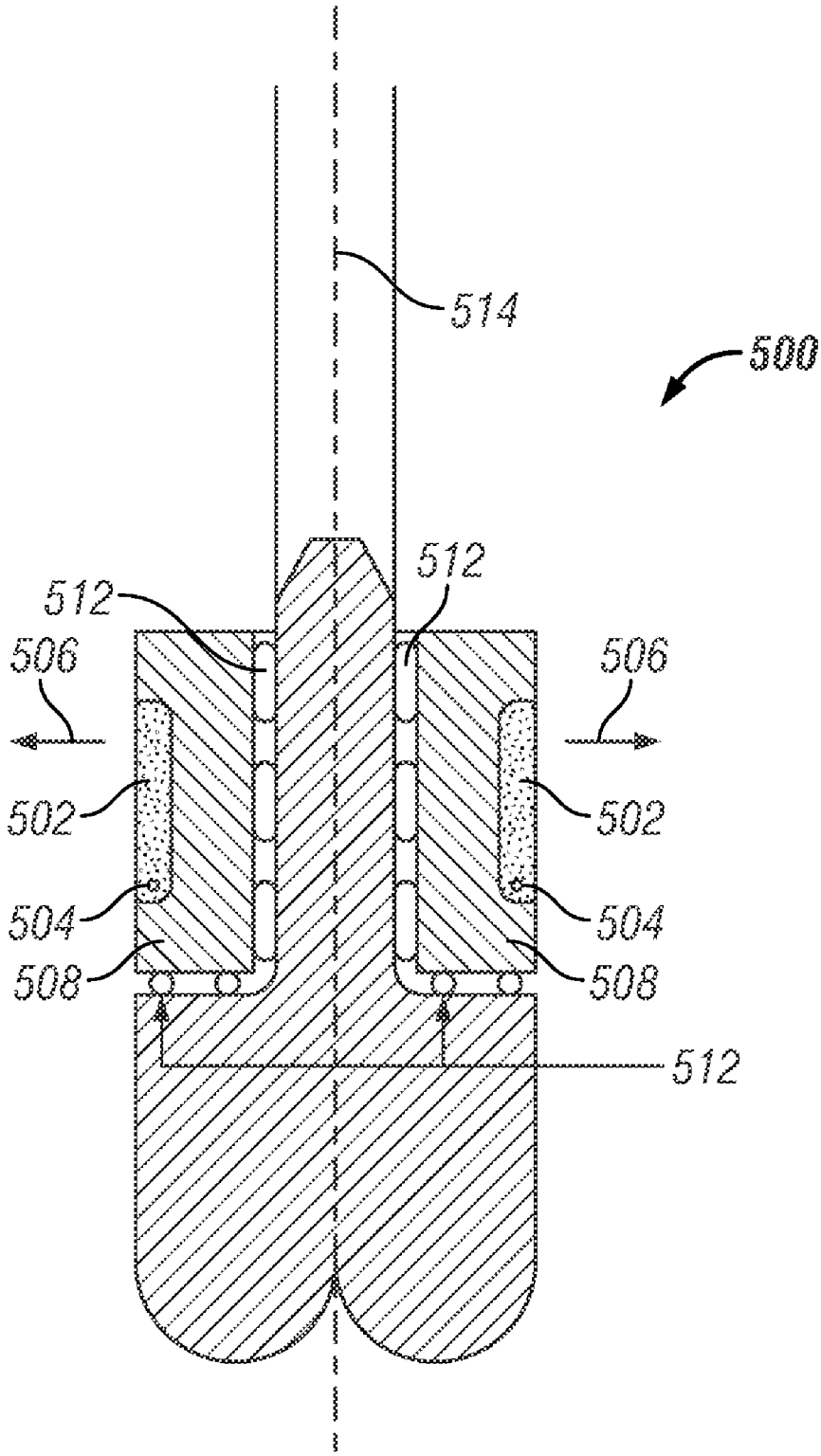
FIG. 5 is a sectional side view of an exemplary drill bit with two force application members located on a floating sleeve, wherein the force application members pivot about an axis perpendicular to a longitudinal bit axis, according to one embodiment of the disclosure.

Referring to FIG. 5, a sectional side view of an exemplary drill bit 500 is illustrated. The assembly includes one or more pads 502 configured to steer the bit 500 during a drilling operation. The pads 502 may be pivotally coupled to the bit via hinge pins 504. The pads 502 may extend in an angular direction 506 to control the direction of the bit 500. A controller, memory, sensors, and communication system may be coupled to the bit 500, pads 502, and other components to correlate pad movements to the desired direction of the drill bit 500. The pads 502 may be substantially flush with a floating sleeve 508 when retracted. The floating sleeve 508 may be a hollow cylindrical member placed about a drill bit body 510. The floating sleeve 508 may be coupled to the body 510 via bearings 512. The bearings 512 enable the body 510 to rotate about longitudinal axis 514 independent of the floating sleeve 508. Accordingly, the drill bit body 510 may rotate at a high rate while the floating sleeve 508 remains substantially stationary with respect to a drill string. By maintaining the floating sleeve 508 in a substantially stationary position, the processing and control of the bit steering by the pads 502 may be simplified. Further, by positioning the pads 502 on the floating sleeve 508 an operator may have more precise control over the direction of the drilling operation. In one aspect, the floating sleeve 508 may be substantially stationary while the bit body 510 rotates. In another aspect, the floating sleeve 508 may rotate at a slower rate than the body 510. The bearings 512 may be any suitable mechanism for reducing friction between rotating components, including rollers, ball bearings, or any other suitable device. In an aspect, the configuration of the pads 502 and pins 504 may be described as perpendicular or substantially perpendicular to the longitudinal axis 514. In the depicted embodiment, actuator mechanisms may be located within the floating sleeve 508 to control movement of the pads 506.

Figure 6:
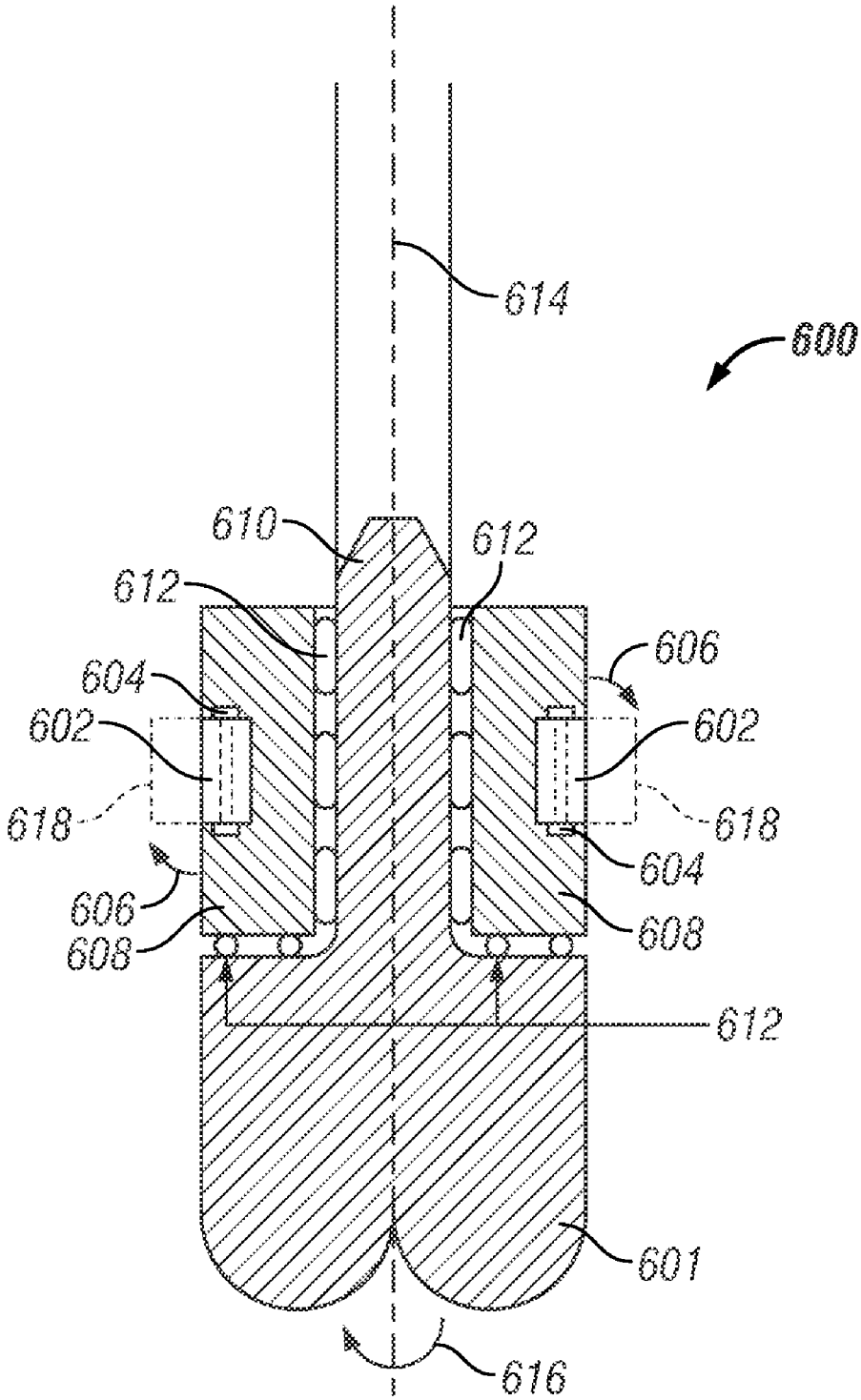
FIG. 6 is a sectional side view of an exemplary drill bit with two force application members located on a floating sleeve, wherein the force application members pivot about an axis parallel to a longitudinal bit axis, according to one embodiment of the disclosure.

FIG. 6 is a sectional side view of an exemplary drill bit 600. The assembly includes a crown section 601 and a plurality of pads 602 configured to steer the bit 600. The pads 602 may be pivotally coupled to the bit via hinge pins 604. The pads 602 may extend in a direction 606 to change the direction of the bit during drilling. The pads 602 may be distributed throughout the bit 600 to provide optimal steering control for an operator. A controller, memory, sensors, and communication system may be coupled to the bit 600, pads 602, and other components to correlate pad movements to the desired direction of the drill bit 600. When retracted, the pads 602 may be substantially flush with a floating sleeve 608. The floating sleeve 608 may be a hollow cylindrical member placed about a drill bit body 610. The floating sleeve 608 may be coupled to the body 610 via bearings 612. The bearings 612 enable the body 610 to rotate about longitudinal axis 614 independent of the floating sleeve 608. In an aspect, the configuration of the pads 602 and pins 604 may be described as parallel or substantially parallel to the longitudinal axis 614. The orientation of the pads 602 may be altered based on a bit rotation direction 616 to reduce wear on the pads 602. As depicted, the illustration further includes a profile 618 of the extended pads.

Figure 7:
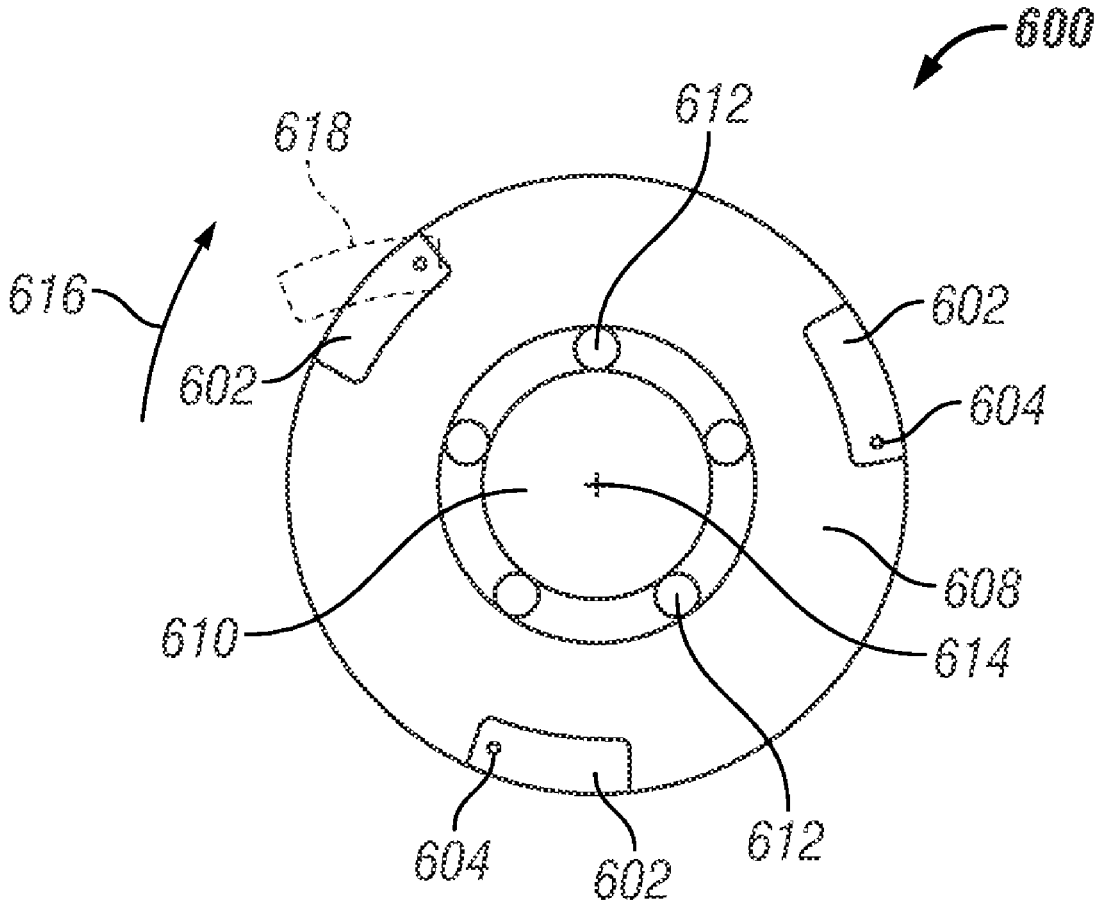
FIG. 7 is a sectional top view of the exemplary drill bit shown in FIG. 6.

FIG. 7 is a top sectional view of the drill bit 600 shown in FIG. 6. The floating sleeve 608 is shown as an annular member placed about the body 610 of the drill bit. The bearings 612 enable rotational bit movement 616 while providing a reduced frictional coupling between the floating sleeve 608 and body 610. In an aspect, each of the three pads 602 are located approximately 120 degrees from the other two pads. The diagram also shows the extended profile 618 of a pad, where the pad pivots on an axis parallel to the longitudinal axis 614.

Figure 8:
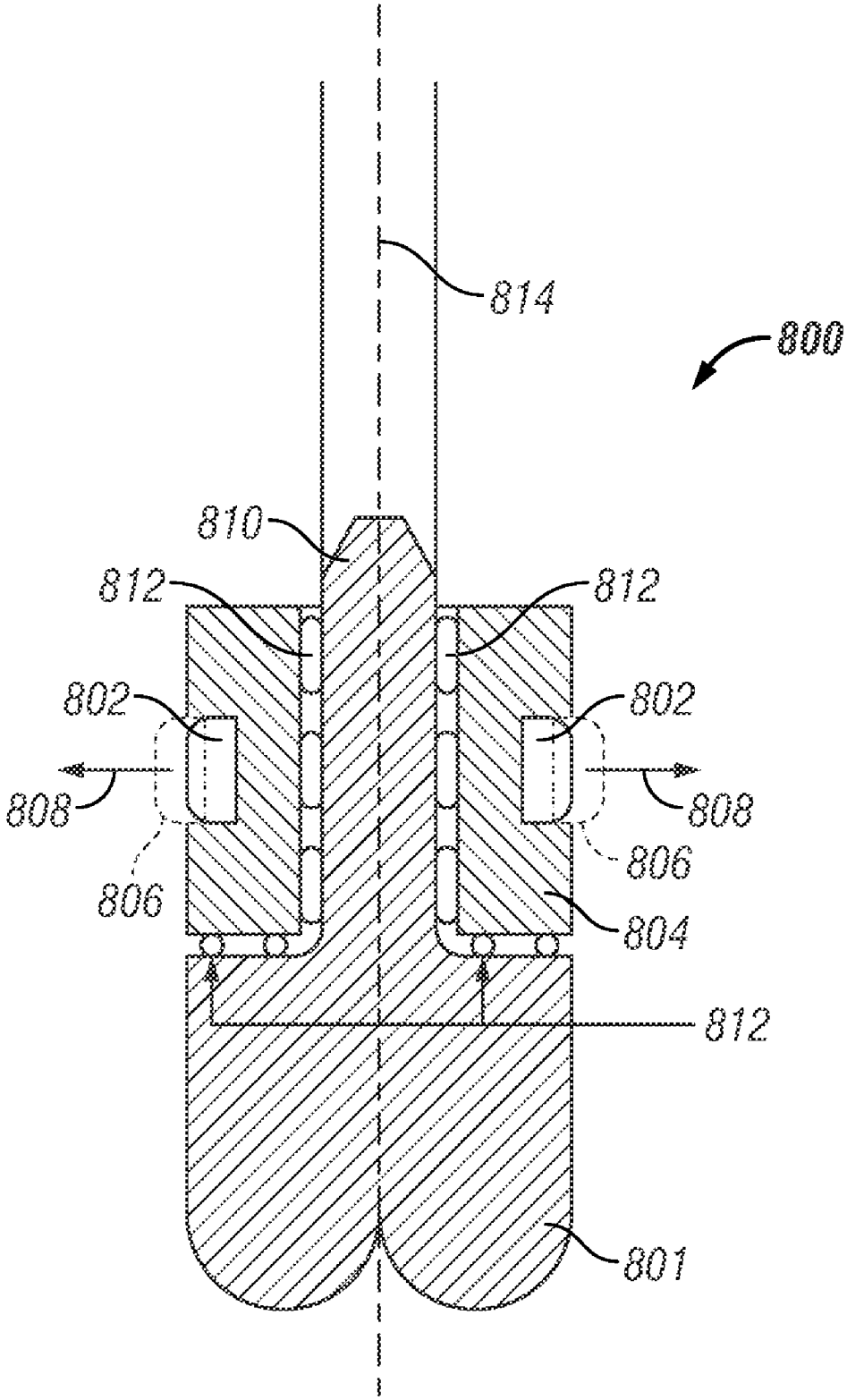
FIG. 8 is a sectional side view of an exemplary drill bit with two force application members located on a floating sleeve, wherein the force application members pivot about an axis perpendicular to a longitudinal bit axis, according to one embodiment of the disclosure.

FIG. 8 is a sectional side view of an exemplary drill bit 800. The assembly includes a crown section 801 and a plurality of pads 802 configured to steer the bit 800. The pads 802 may extend in a direction 808 to change the direction of the bit during drilling. In one aspect, the force application device may include a floating member 804, such as a floating sleeve, mounted on an outside of the drill bit body 810. The floating sleeve 804 may be a hollow cylindrical member placed about a drill bit body 810. The floating sleeve 804 may be coupled to the drill bit body 810 via bearings 812. The bearings 812 enable the drill bit body 810 to rotate about longitudinal axis 814 independent of the floating member 804. The floating member 804 may be placed in a recess around a suitable location on the drill bit body 810, such as the shank. In one aspect, the floating member 804 may be configured to rotate more slowly than the drill bit 800 and in another aspect the floating member 804 may be stationary or substantially stationary with respect to the rotation of the drill bit body 810. In one aspect, the pads 802 may move radially outward from the floating sleeve 804 when driven by an actuator (not shown). Further, the pads 802 may be distributed at any number of suitable locations around the drill bit 800 to provide optimal steering of the drill bit in a wellbore. As depicted, the illustration includes a profile 806 of the extended pads. A controller, memory, sensors, and communication system may be coupled to the bit 800, pads 802, and other components to correlate pad movements to the desired direction of the drill bit 800. When retracted, the pads 802 may be substantially flush with the floating sleeve 804.

Figure 9:
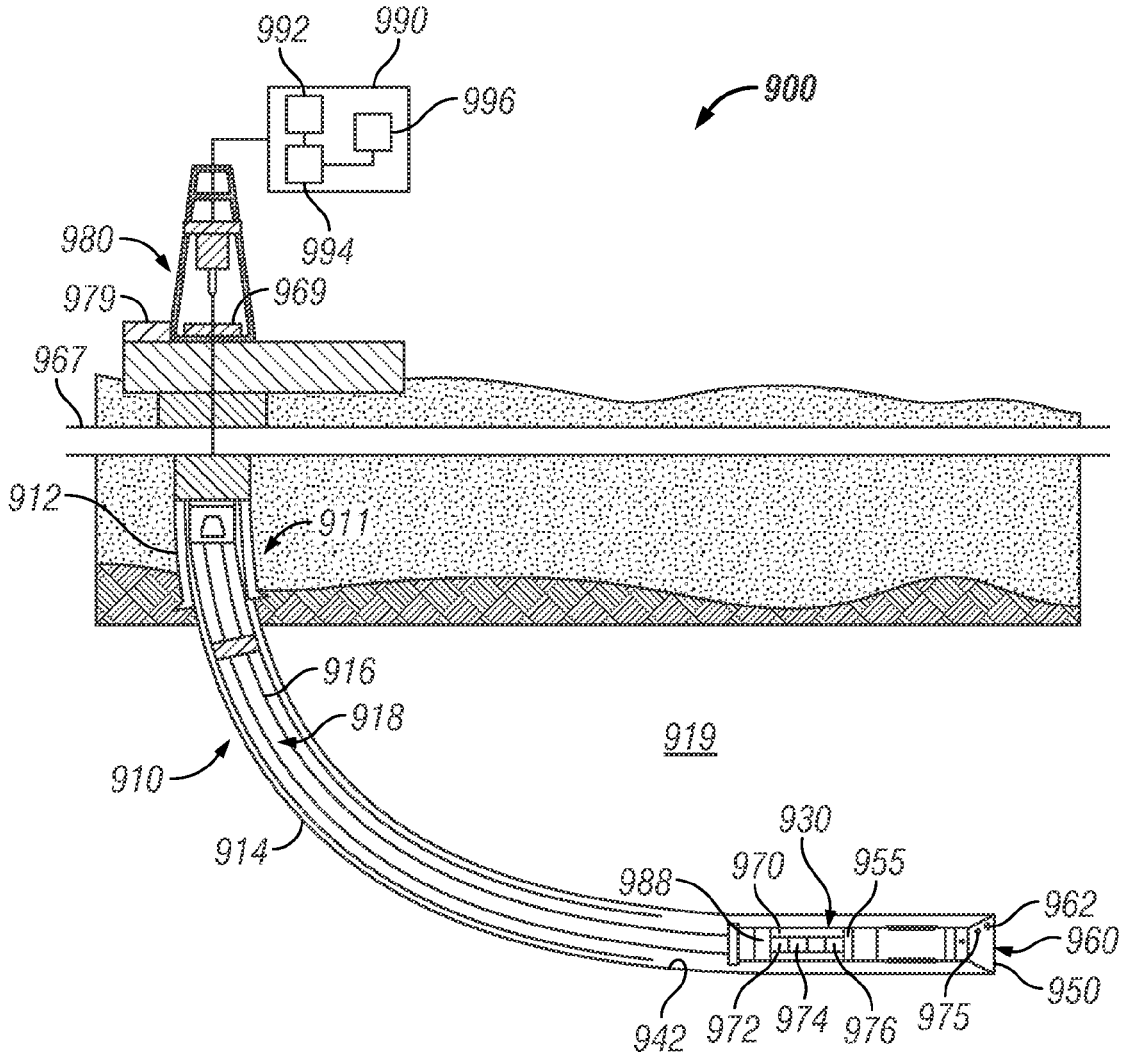
FIG. 9 is a schematic diagram of an exemplary drilling system that includes a drill bit having a force application device made according to one embodiment of the disclosure.

FIG. 9 is a schematic diagram of an exemplary drilling system 900 that may utilize drill bits made according to one or more embodiments of the disclosure. FIG. 9 shows a wellbore 910 having an upper section 911 with a casing 912 installed therein and a lower section 914 being drilled with a drill string 918. The drill string 918 is shown to include a tubular member 916 with a BHA 930 (also referred to as the "drilling assembly" or "bottomhole assembly" ("BHA") attached at its bottom end. The tubular member 916 may be a series of joined drill pipe sections or it may be a coiled-tubing. A drill bit 950 is shown attached to the bottom end of the BHA 930 for disintegrating the rock formation to drill the wellbore 910 of a selected diameter in the formation 919. The drill bit includes one or more force application devices 960 made according to one or more embodiments of this disclosure.

Drill string 918 is shown conveyed into the wellbore 910 from a rig 980 at the surface 967. The exemplary rig 980 shown is a land rig for ease of explanation. The apparatus and methods disclosed herein may also be utilized with offshore rigs. A rotary table 969 or a top drive (not shown) coupled to the drill string 918 may be utilized to rotate the drill string 918 to rotate the BHA 930 and the drill bit 950 to drill the wellbore 910. A drilling motor 955 (also referred to as the "mud motor") may be provided in the BHA 930 to rotate the drill bit 950. The drilling motor 955 may be used alone to rotate the drill bit or to superimpose the rotation of the drill string 918. A control unit (or controller) 990, which may be a computer-based unit, may be placed at the surface for receiving and processing data transmitted by the sensors in the drill bit 950 and the BHA 930 and for controlling selected operations of the various devices and sensors in the drilling assembly 930. The surface controller 990, in one embodiment, may include a processor 992, a data storage device (or a computer-readable medium) 994 for storing data and computer programs 996. The data storage device 994 may be any suitable device, including, but not limited to, a read-only memory (ROM), a random-access memory (RAM), a flash memory, a magnetic tape, a hard disk and an optical disk. During drilling, a drilling fluid 979 from a source thereof is pumped under pressure into the tubular member 916. The drilling fluid discharges at the bottom of the drill bit 950 and returns to the surface via the annular space (also referred as the "annulus") between the drill string 918 and the inside wall 942 of the wellbore 910.

The BHA 930 may further include one or more downhole sensors, including, but not limited to, sensors generally known as the measurement-while-drilling (MWD) sensors or the logging-while-drilling (LWD) sensors, and sensors that provide information about the behavior of the BHA 930, such as drill bit rotation, vibration, whirl, and stick-slip (collectively designated in FIG. 9 by numeral 975) and at least one control unit (or controller) 970 for controlling the operation of the force application members 962 and for at least partially processing data received from the sensors 975 and the drill bit 950. The controller 970 may include, among other things, a processor 972, such as a microprocessor, a data storage device 974, such as a solid-state-memory, and a program 976 for use by the processor 972 to control the operation of the force application members 960, process downhole data and also communicate with the controller 90 via a two-way telemetry unit 988.

The drill bit 950 may include one or more sensors 955, including, but not limited to, accelerometers, magnetometers, torque sensors, weight sensors, resistivity sensors, and acoustic sensors for providing information about various parameters of interest. The drill bit 950 also may include a processor and a communication link for providing two-way communication between the drill bit 950 and the BHA 930. During drilling of the wellbore 910, one or more force application devices 960 are activated to apply force on the wellbore wall. Using three force application devices typically provides adequate force vectors to cause the drill bit 950 to move into any desired direction. The drill bit 950 may also include more that three or less than three force application devices. Each force application member may be independently operated by its associated actuator, which may be located in the drill bit or in the BHA. The processor in the BHA and/or in the drill bit may cause each force application device to apply a selected force on the wellbore wall in accordance with instruction programs and instructions available to the processor in the drill bit, BHA and/or the surface to drill the wellbore along a desired path or trajectory.

While the foregoing disclosure is directed to certain embodiments, various changes and modifications to such embodiments will be apparent to those skilled in the art. It is intended that all changes and modifications that are within the scope and spirit of the appended claims be embraced by the disclosure herein.

What is claimed is:

1. A drill bit, comprising:

a force application device on a body of a drill bit, the force application device including a floating member and a force application member configured to extend from the floating member to apply a force on a wellbore wall when the drill bit is used to drill a wellbore, wherein the force application device is positioned proximate a crown of the drill bit and the drill bit is configured to be coupled to a bottomhole assembly; and an actuator configured to actuate the force application member to apply the force to a wellbore wall during drilling of the wellbore.

2. The drill bit of claim 1, wherein the floating member is configured to rotate around the body or remain substantially stationary relative to the body of the drill bit.

3. The drill bit of claim 1, comprising a bearing between the floating member and the body of the drill bit configured to enable the floating member to move relative to the body of the drill bit.

4. The drill bit of claim 1, further comprising a bearing and seal between the floating member and the body of the drill bit configured to enable the floating member to move relative to the body of the drill bit.

5. The drill bit of claim 1, wherein the force application member is pivotally coupled to the floating member.

6. The drill bit of claim 5, wherein the force application member pivots along one of an axis perpendicular to a longitudinal drill bit axis and an axis parallel to a longitudinal drill bit axis.

7. The drill bit of claim 1, wherein the force application member does not cut into the wellbore wall.

8. The drill bit of claim 1, wherein the force application member is substantially flush with the surface of the member when the force application member is not extended.

9. The drill bit of claim 1, wherein the actuator comprises one selected from the group consisting of: a hydraulic actuator; a linear electrical device; a shape memory alloy; and an electromechanical actuator.

10. A method of making a drill bit, comprising:

providing a force application device on a body of the drill bit and positioned proximate a crown of the drill bit, the drill bit being configured to be coupled to a bottomhole assembly, the force application device including a floating member and a force application member on the force application device, the force application member configured to extend from the floating member to apply a force on a wellbore wall when the drill bit is used to drill a wellbore; and providing an actuator configured to actuate the force application member to apply the force to a wellbore wall during drilling of the wellbore.

11. The method of claim 10, wherein providing the floating member comprises providing the floating member configured to rotate around the body or remain substantially stationary relative to the body of the drill bit.

12. The method of claim 10, comprising providing a bearing or a bearing and seal between the floating member and the body of the drill bit configured to enable the floating member to move relative to the body of the drill bit.

13. The method of claim 10, wherein the force application member is pivotally coupled to the floating member.

14. The method of claim 13, wherein the force application member pivots along an axis perpendicular to one of a longitudinal drill bit axis and an axis parallel to a longitudinal drill bit axis.

15. The method of claim 10, wherein the force application member is substantially flush with the surface of the member when the force application member is not extended.

16. An apparatus for drilling a wellbore, comprising:

a bottomhole assembly;

a drill bit configured to be coupled to the bottomhole assembly, the drill bit including a force application device positioned proximate a crown of the drill bit and on a body of the drill bit, the force application device further including a floating member and a force application member configured to extend from the floating member to apply a force on a wellbore wall when the drill bit is used to drill a wellbore; and an actuator configured to actuate the force application member to apply the force to a wellbore wall during drilling of the wellbore.

17. The apparatus of claim 16, wherein the force application member does not include cutters.

18. The apparatus of claim 16, wherein the floating member is configured to rotate around the body or remain substantially stationary relative to the body of the drill bit.

* * * * *